US011168448B2

(12) United States Patent
Lanahan et al.

(10) Patent No.: US 11,168,448 B2
(45) Date of Patent: Nov. 9, 2021

(54) VIBRATORY ECCENTRIC ASSEMBLIES FOR COMPACTION MACHINES

(71) Applicant: Volvo Construction Equipment AB, Eskilstuna (SE)

(72) Inventors: Stephen Lanahan, Gettysburg, PA (US); Robert Law, Greencastle, PA (US); Shankar Nagaraj, Mechanicsburg, PA (US)

(73) Assignee: Volvo Construction Equipment AB, Eskilstuna (SE)

( * ) Notice: Subject to any disclaimer, the term of this patent is extended or adjusted under 35 U.S.C. 154(b) by 53 days.

(21) Appl. No.: 16/620,208

(22) PCT Filed: Jun. 19, 2017

(86) PCT No.: PCT/US2017/038071

§ 371 (c)(1),
(2) Date: Dec. 6, 2019

(87) PCT Pub. No.: WO2018/236333

PCT Pub. Date: Dec. 27, 2018

(65) Prior Publication Data

US 2021/0079601 A1 Mar. 18, 2021

(51) Int. Cl.
*E01C 19/00* (2006.01)
*E01C 19/28* (2006.01)
(Continued)

(52) U.S. Cl.
CPC ..... *E01C 19/286* (2013.01); *B06B 1/162* (2013.01); *E02D 3/074* (2013.01)

(58) Field of Classification Search
CPC ..... E01C 19/286; E02D 3/074; B06B 1/162
(Continued)

(56) References Cited

U.S. PATENT DOCUMENTS 2,061,943 A * 11/1936 Jorgensen ..... E04G 21/08 366/123
2,178,881 A * 11/1939 Roeth ..... F16C 19/54 366/123

(Continued)

FOREIGN PATENT DOCUMENTS

CN 102985616 A 3/2013
CN 102995521 A 3/2013

(Continued)

OTHER PUBLICATIONS

International Search Report and Written Opinion of the International Searching Authority, PCT/US2017/038071, dated Aug. 21, 2017, 6 pages.

(Continued)

*Primary Examiner* — Raymond W Addie
(74) *Attorney, Agent, or Firm* — Sage Patent Group

(57) ABSTRACT

An eccentric assembly for a compaction machine may include an outer eccentric mass and first and second inner eccentric masses. A length of the outer eccentric mass is in a direction of an axis of rotation of the outer eccentric mass. The first inner eccentric mass is rotatably connected to the outer eccentric mass by a first joint, and the second inner eccentric mass is rotatably connected to the outer eccentric mass by a second joint. Moreover, the first and second inner eccentric masses are separate, and the first and second joints are separate. Related compaction machines are also discussed.

20 Claims, 6 Drawing Sheets

(51) Int. Cl.
*B06B 1/16* (2006.01)
*E02D 3/074* (2006.01)

(58) Field of Classification Search
USPC ..... 404/113, 117, 118
See application file for complete search history.

(56) References Cited

U.S. PATENT DOCUMENTS 3,202,402 A * 8/1965 Giertz-Hedstrom .... E04G 21/08 366/123
3,266,739 A 8/1966 McKibben
3,640,508 A * 2/1972 Reibig ..... B06B 1/166 366/116
3,771,768 A * 11/1973 Gebendinger ..... A01D 46/26 366/128
3,892,496 A 7/1975 Lebrero Martinez
3,947,142 A 3/1976 Takata et al.
4,270,396 A * 6/1981 Fallows ..... B06B 1/16 366/128
4,590,814 A * 5/1986 Wadensten ..... B06B 1/16 310/51
5,010,778 A * 4/1991 Riedl ..... B06B 1/164 366/128
6,551,020 B2 * 4/2003 Swanson ..... B06B 1/161 404/103
9,039,324 B2 5/2015 Ackermann et al.
9,725,855 B2 * 8/2017 Kreische ..... E02D 3/074
9,737,910 B2 * 8/2017 Smith ..... E01C 19/286
9,970,163 B2 * 5/2018 Magalski ..... E01C 19/281
10,166,573 B2 * 1/2019 Karcz ..... E01C 19/286
10,227,737 B1 * 3/2019 Goebel ..... E02D 3/074
10,487,461 B2 * 11/2019 Budzianowski ..... B06B 1/16
10,577,757 B1 * 3/2020 Stern ..... E01C 19/281
2003/0021629 A1 * 1/2003 Swanson ..... E01C 19/286 404/117
2004/0182185 A1 9/2004 Niglov
2011/0290048 A1 * 12/2011 Stein ..... E02D 3/074 74/61
2015/0139731 A1 5/2015 Persson et al.
2017/0014867 A1 * 1/2017 Smith ..... B06B 1/162

FOREIGN PATENT DOCUMENTS

CN 104653592 A 5/2015
DE 202014105626 U1 2/2016

OTHER PUBLICATIONS

Chinese First Office Action dated Dec. 3, 2020 for Chinese Patent Application No. 201780092250.4, 11 pages (including English translation).
Extended European Search Report dated Jan. 15, 2021 for European Patent Application No. 17915099.0, 8 pages.

* cited by examiner

VIBRATORY ECCENTRIC ASSEMBLIES FOR COMPACTION MACHINES

CROSS REFERENCE TO RELATED APPLICATIONS

This application is a 35 U.S.C. § 371 national stage application of PCT International Application No. PCT/US2017/038071 filed on Jun. 19, 2017, the disclosure and content of which are incorporated by reference herein in their entirety.

TECHNICAL FIELD

The present disclosure relates to the field of compaction machines, and more particularly, to vibratory eccentrics for compaction machines.

BACKGROUND

Certain soil compaction machines may operate with a vibratory eccentric system that assists in the compaction of a substrate, such as, for example, soil or asphalt. Depending on the substrate type and/or requirements of the job, an operator of the compaction machine may select from drum configurations that provide a desired compaction. Compaction vibration may often times be adjusted, for example, by adjusting a speed or frequency at which an eccentric mass (es) rotates. Additionally, often times, the vibrational impact force or amplitude may be adjustable.

In some designs, the amplitude is adjusted by the provision of a rotatable joint that connects an inner secondary eccentric mass to an outer primary eccentric mass. The rotatable joint allows relative phase changes between the primary and secondary weight about an axis of rotation. Due to the forces involved during the operation of such vibratory eccentric systems, the rotatable joint between the primary and secondary weight is subject to significant wear and risk of failure.

Some embodiments of the present invention may be directed to an improved vibratory eccentric system for compaction machines.

SUMMARY

According to one embodiments of inventive concepts, an eccentric assembly for a compaction machine may include an outer eccentric mass and first and second inner eccentric masses. A length of the outer eccentric mass is in a direction of an axis of rotation of the outer eccentric mass. The first inner eccentric mass is rotatably connected to the outer eccentric mass by a first joint, and the second inner eccentric mass is rotatably connected to the outer eccentric mass by a second joint. More particularly, the first and second inner eccentric masses are separate, and the first and second joints are separate.

According to other embodiments of inventive concepts, a compaction machine may include a chassis, a drum, an eccentric assembly mounted inside the drum, and a vibration motor coupled to the eccentric assembly. The drum is rotatably connected to the chassis to allow rotation of the drum over a work surface. The eccentric assembly includes an outer eccentric mass, a first inner eccentric mass, and a second inner eccentric mass. A length of the outer eccentric mass is in a direction of an axis of rotation of the outer eccentric mass. The first inner eccentric mass is rotatably connected to the outer eccentric mass by a first joint. The second inner eccentric mass is rotatably connected to the outer eccentric mass by a second joint. Moreover, the first and second inner eccentric masses are separate, and the first and second joints are separate. The vibration motor is configured to rotate the outer eccentric mass in a first direction about the axis of rotation of the outer eccentric mass so that the first and second inner eccentric masses move to respective first positions relative to the outer eccentric mass to provide high amplitude vibration, and the vibration motor is configured to rotate the outer eccentric mass in a second direction about the axis of rotation of the outer eccentric mass so that the first and second inner eccentric masses move to respective second positions relative to the outer eccentric mass to provide low amplitude vibration.

ASPECTS

According to one aspect, an eccentric assembly for a compaction machine includes an outer eccentric mass and first and second inner eccentric masses. A length of the outer eccentric mass is in a direction of an axis of rotation of the outer eccentric mass. The first inner eccentric mass is rotatably connected to the outer eccentric mass by a first joint, and the second inner eccentric mass is rotatably connected to the outer eccentric mass by a second joint. More particularly, the first and second inner eccentric masses are separate, and the first and second joints are separate.

The first and second joints may be spaced apart in the direction of the axis of rotation of the outer eccentric mass, the first joint may be aligned with a center of mass of the first inner eccentric mass, and the second joint may be aligned with a center of mass of the second inner eccentric mass. The first joint may be a first double shear joint, and the second joint may be a second double shear joint.

The first double shear joint may include a first tab extending from the outer eccentric mass in a direction orthogonal with respect to the axis of rotation, and the second double shear joint may include a second tab extending from the outer eccentric mass in a direction orthogonal with respect to the axis of rotation. The first double shear joint may include third and fourth tabs extending from the first inner eccentric mass to opposite sides of the first tab and a first pin extending through the first, third, and fourth tabs. Similarly, the second double shear joint may include fifth and sixth tabs extending from the second inner eccentric mass to opposite sides of the second tab and a second pin extending through the second, fifth, and sixth tabs. Moreover, the first pin may define an axis of rotation of the first double shear joint that is parallel with the axis of rotation of the outer eccentric mass, and the second pin may define an axis of rotation of the second double shear joint that is parallel with the axis of rotation of the outer eccentric mass, The eccentric assembly may also include first and second stops extending from the outer eccentric mass. The first stop may be longitudinally centered with respect to the first joint and with respect to the center of mass of the first inner eccentric mass. The second stop may be longitudinally centered with respect to the second joint and with respect to the center of mass of the second inner eccentric mass, and the first and second stops may be spaced apart. A line of action of the first stop may extend through the center of mass of the first inner eccentric mass and orthogonal to the axis of rotation of the first joint, and a line of action of the second stop may extend through the center of mass of the second inner eccentric mass and orthogonal to the axis of rotation of the second joint.

The outer eccentric mass may have a recess. The first and second inner eccentric masses may be configured to move to respective first positions seated in the recess of the outer eccentric mass and spaced apart from the respective first and second stops responsive to rotation of the outer eccentric mass in a first direction about the axis of rotation of the outer eccentric mass. The first and second inner eccentric masses may be configured to move to respective second positions against the respective first and second stops responsive to rotation of the outer eccentric mass in a second direction about the axis of rotation of the outer eccentric mass.

In addition, first and second mounting journals may extend from opposite ends of the outer eccentric mass, with the first and second mounting journals being aligned with the axis of rotation of the outer eccentric mass.

The eccentric assembly may further include a third inner eccentric mass between the first and second inner eccentric masses. The third inner eccentric mass may be rotatably connected to the outer eccentric mass by a third joint. Moreover, the first, second, and third inner eccentric masses may be separate, and the first, second, and third joints may be separate. The first, second, and third inner eccentric masses may have a same mass, or the third inner eccentric mass may have a mass that is different than that of the first and second inner eccentric masses.

According to another aspect, a compaction machine may include a chassis, a drum, an eccentric assembly mounted inside the drum, and a vibration motor coupled to the eccentric assembly. The drum is rotatably connected to the chassis to allow rotation of the drum over a work surface. The eccentric assembly includes an outer eccentric mass, a first inner eccentric mass, and a second inner eccentric mass. A length of the outer eccentric mass is in a direction of an axis of rotation of the outer eccentric mass. The first inner eccentric mass is rotatably connected to the outer eccentric mass by a first joint. The second inner eccentric mass is rotatably connected to the outer eccentric mass by a second joint. Moreover, the first and second inner eccentric masses are separate, and the first and second joints are separate. The vibration motor is configured to rotate the outer eccentric mass in a first direction about the axis of rotation of the outer eccentric mass so that the first and second inner eccentric masses move to respective first positions relative to the outer eccentric mass to provide high amplitude vibration, and the vibration motor is configured to rotate the outer eccentric mass in a second direction about the axis of rotation of the outer eccentric mass so that the first and second inner eccentric masses move to respective second positions relative to the outer eccentric mass to provide low amplitude vibration.

The first and second joints may be spaced apart in the direction of the axis of rotation of the outer eccentric mass, the first joint may be aligned with a center of mass of the first inner eccentric mass, and the second joint may be aligned with a center of mass of the second inner eccentric mass. The first joint may be a first double shear joint, and the second joint may be a second double shear joint. The first double shear joint may include a first tab extending from the outer eccentric mass in a direction orthogonal with respect to the axis of rotation, and the second double shear joint may include a second tab extending from the outer eccentric mass in a direction orthogonal with respect to the axis of rotation. The first double shear joint may include third and fourth tabs extending from the first inner eccentric mass to opposite sides of the first tab and a first pin extending through the first, third, and fourth tabs, and the second double shear joint may include fifth and sixth tabs extending from the second inner eccentric mass to opposite sides of the second tab and a second pin extending through the second, fifth, and sixth tabs. The first pin may define an axis of rotation of the first double shear joint that is parallel with the axis of rotation of the outer eccentric mass, and the second pin may define an axis of rotation of the second double shear joint that is parallel with the axis of rotation of the outer eccentric mass.

The eccentric assembly may further include first and second stops extending from the outer eccentric mass. The first stop may be longitudinally centered with respect to the first joint and with respect to the center of mass of the first inner eccentric mass. The second stop may be longitudinally centered with respect to the second joint and with respect to the center of mass of the second inner eccentric mass, and the first and second stops may be spaced apart. A line of action of the first stop may extend through the center of mass of the first inner eccentric mass and orthogonal to the axis of rotation of the first joint, and a line of action of the second stop may extend through the center of mass of the second inner eccentric mass and orthogonal to the axis of rotation of the second joint.

The outer eccentric mass may have a recess, the first and second inner eccentric masses may be configured to move to the respective first positions seated in the recess of the outer eccentric mass and spaced apart from the respective first and second stops responsive to rotation of the outer eccentric mass in the first direction to provide the high amplitude vibration. The first and second inner eccentric masses may be configured to move to the respective second positions against the respective first and second stops responsive to rotation of the outer eccentric mass in the second direction to provide the low amplitude vibration.

The eccentric assembly may also include first and second mounting journals extending from opposite ends of the outer eccentric mass with the first and second mounting journals being aligned with the axis of rotation of the outer eccentric mass. In addition, the compaction machine may include a coupling between the second journal and the and the vibration motor, with the coupling providing drive input from the vibration motor to the eccentric assembly.

The compaction machine may also include a drive motor coupled with a second drum and/or a traction wheel to propel the compaction machine, and a driver station on the chassis including a steering mechanism to allow a driver to control operation of the compaction machine.

According to still another aspect, a drum assembly for a compaction machine may include a drum, an eccentric assembly mounted inside the drum, and a vibration motor coupled to the eccentric assembly. The eccentric assembly includes an outer eccentric mass, a first inner eccentric mass, and a second inner eccentric mass. A length of the outer eccentric mass is in a direction of an axis of rotation of the outer eccentric mass. The first inner eccentric mass is rotatably connected to the outer eccentric mass by a first joint. The second inner eccentric mass is rotatably connected to the outer eccentric mass by a second joint. Moreover, the first and second inner eccentric masses are separate, and the first and second joints are separate. The vibration motor is configured to rotate the outer eccentric mass in a first direction about the axis of rotation of the outer eccentric mass so that the first and second inner eccentric masses move to respective first positions relative to the outer eccentric mass to provide high amplitude vibration, and the vibration motor is configured to rotate the outer eccentric mass in a second direction about the axis of rotation of the outer eccentric mass so that the first and second inner eccentric masses move to respective second positions relative to the outer eccentric mass to provide low amplitude vibration.

According to still another aspect, an eccentric assembly for a compaction machine includes an outer eccentric mass and an inner eccentric mass. A length of the outer eccentric mass is in a direction of an axis of rotation of the outer eccentric mass. The inner eccentric mass is rotatably connected to the outer eccentric mass by a double shear joint that is aligned with a center of mass of the inner eccentric mass.

Other eccentric assemblies, drums, and compaction machines according to aspects or embodiments will be or become apparent to those with skill in the art upon review of the following drawings and detailed description. It is intended that all such additional eccentric assemblies, drums, and compaction machines be included within this description and protected by the accompanying claims. Moreover, it is intended that all aspects and embodiments disclosed herein can be implemented separately or combined in any way and/or combination.

BRIEF DESCRIPTION OF THE DRAWINGS

The accompanying drawings, which are included to provide a further understanding of the disclosure and are incorporated in a constitute a part of this application, illustrate certain non-limiting embodiments of inventive concepts. In the drawings.

DETAILED DESCRIPTION

Inventive concepts will now be described more fully hereinafter with reference to the accompanying drawings, in which examples of embodiments of inventive concepts are shown. Inventive concepts may, however, be embodied in many different forms and should not be construed as limited to the embodiments set forth herein. Rather, these embodiments are provided so that this disclosure will be thorough and complete, and will fully convey the scope of present inventive concepts to those skilled in the art. It should also be noted that these embodiments are not mutually exclusive. Components from one embodiment may be tacitly assumed to be present/used in another embodiment. Any two or more embodiments described below may be combined in any way with each other. Moreover, certain details of the described embodiments may be modified, omitted, or expanded upon without departing from the scope of the described subject matter.

Figure 1:
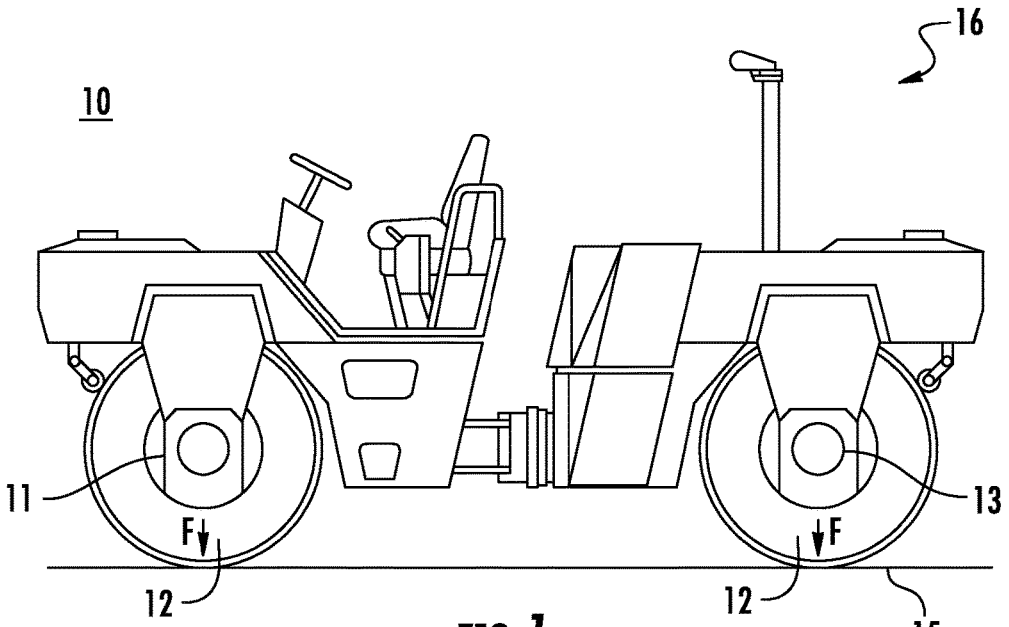
FIG. 1 is a side view of a compaction machine according to some embodiments of inventive concepts.

FIG. 1 illustrates a compaction machine 10 according to some embodiments of inventive concepts. The compaction machine 10 of FIG. 1 includes a chassis 16 and rotatable drums 12 located at opposite ends of the chassis 16. In the present embodiment, one or both of the drums 12 is/are driven by a drive motor 11 and/or 13. As discussed in greater detail below, eccentric assemblies may be used to increase a force F on work surface 15.

Figure 2:
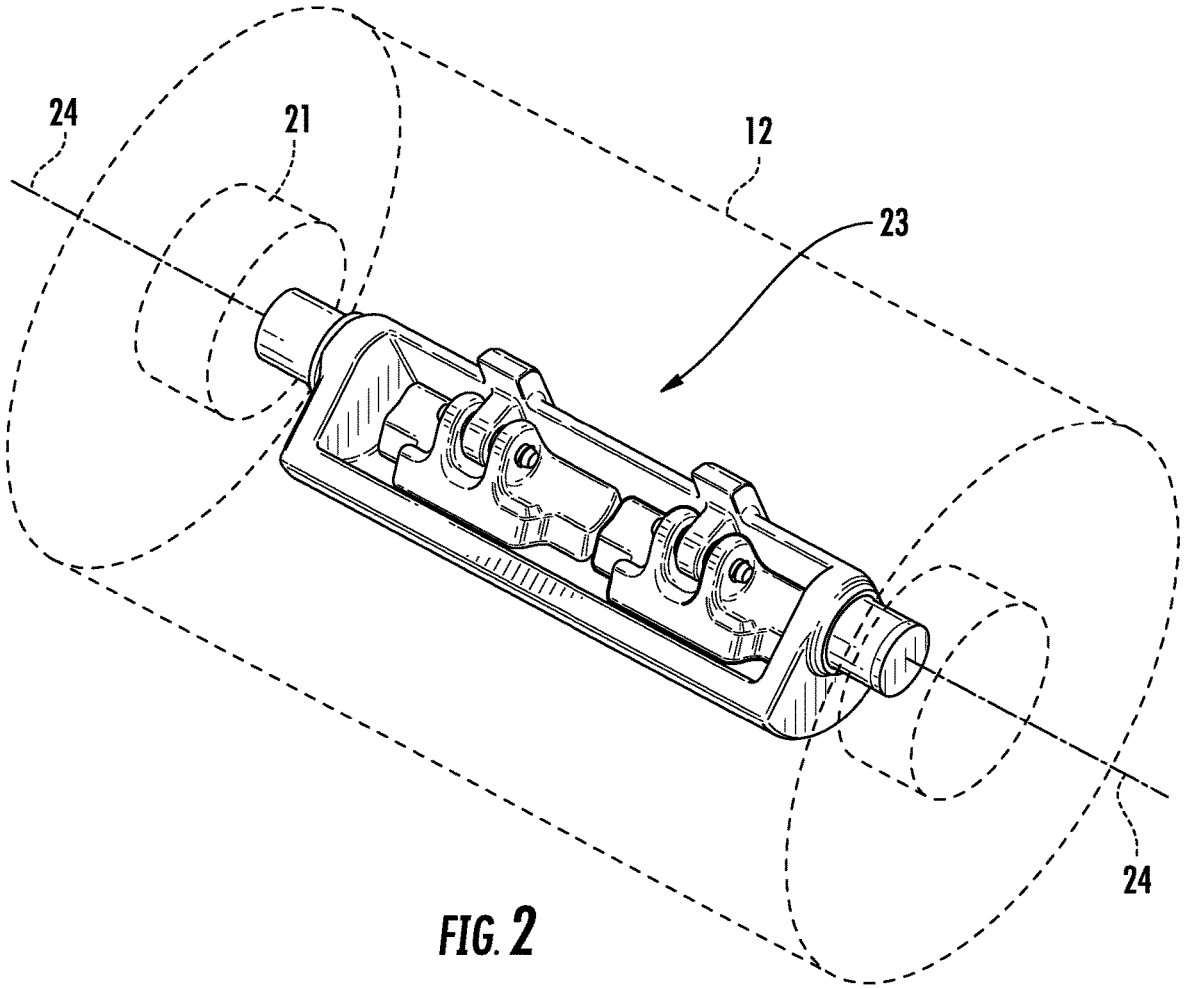
FIG. 2 is a perspective view of a drum of the compaction machine of FIG. 1 including a vibration motor and eccentric assembly according to some embodiments of inventive concepts.
Figure 3A:
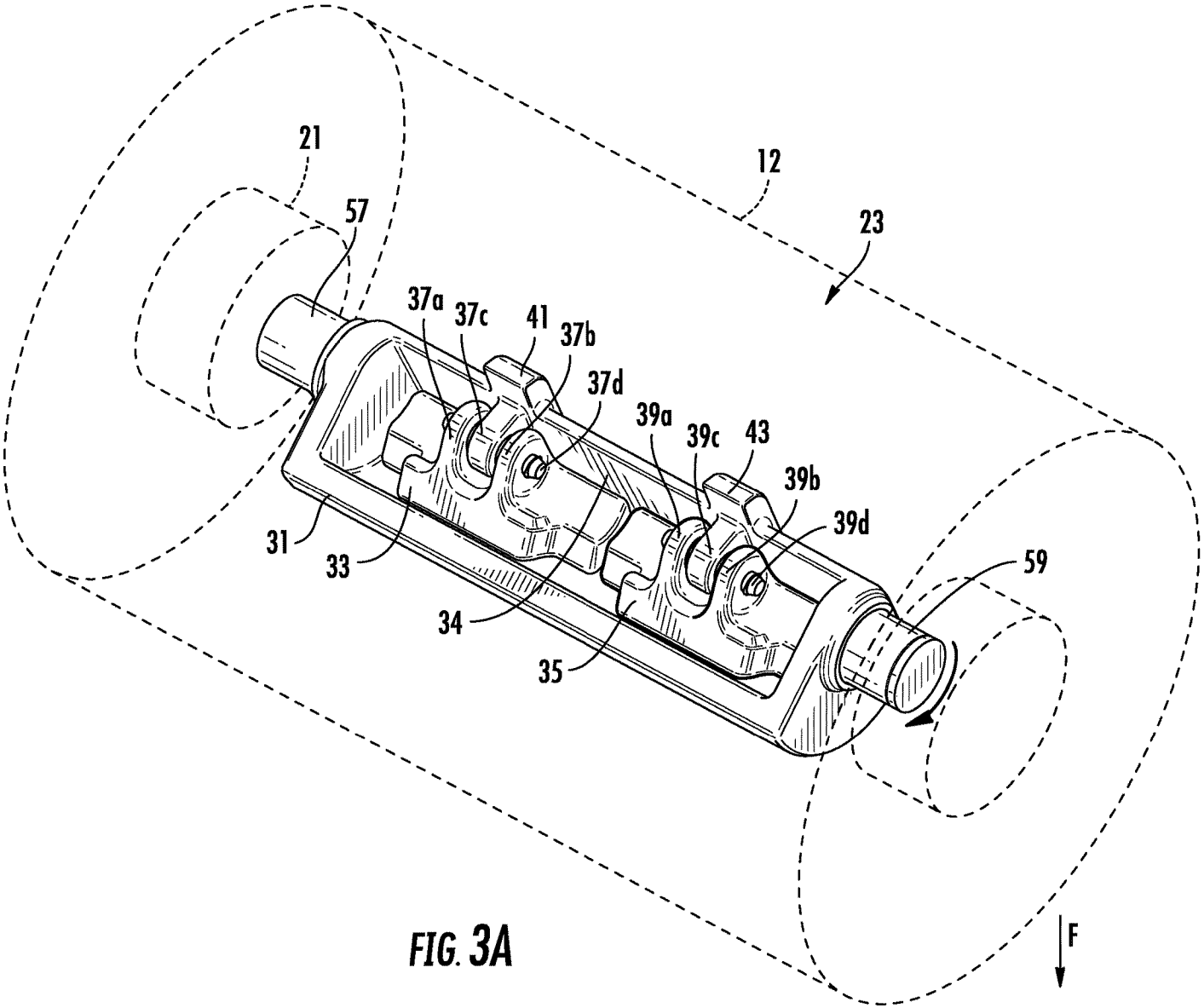
FIGS. 3A and 3B are perspective views of an eccentric assembly of FIG. 2 in respective high and low amplitude orientations according to some embodiments of inventive concepts.
Figure 3B:
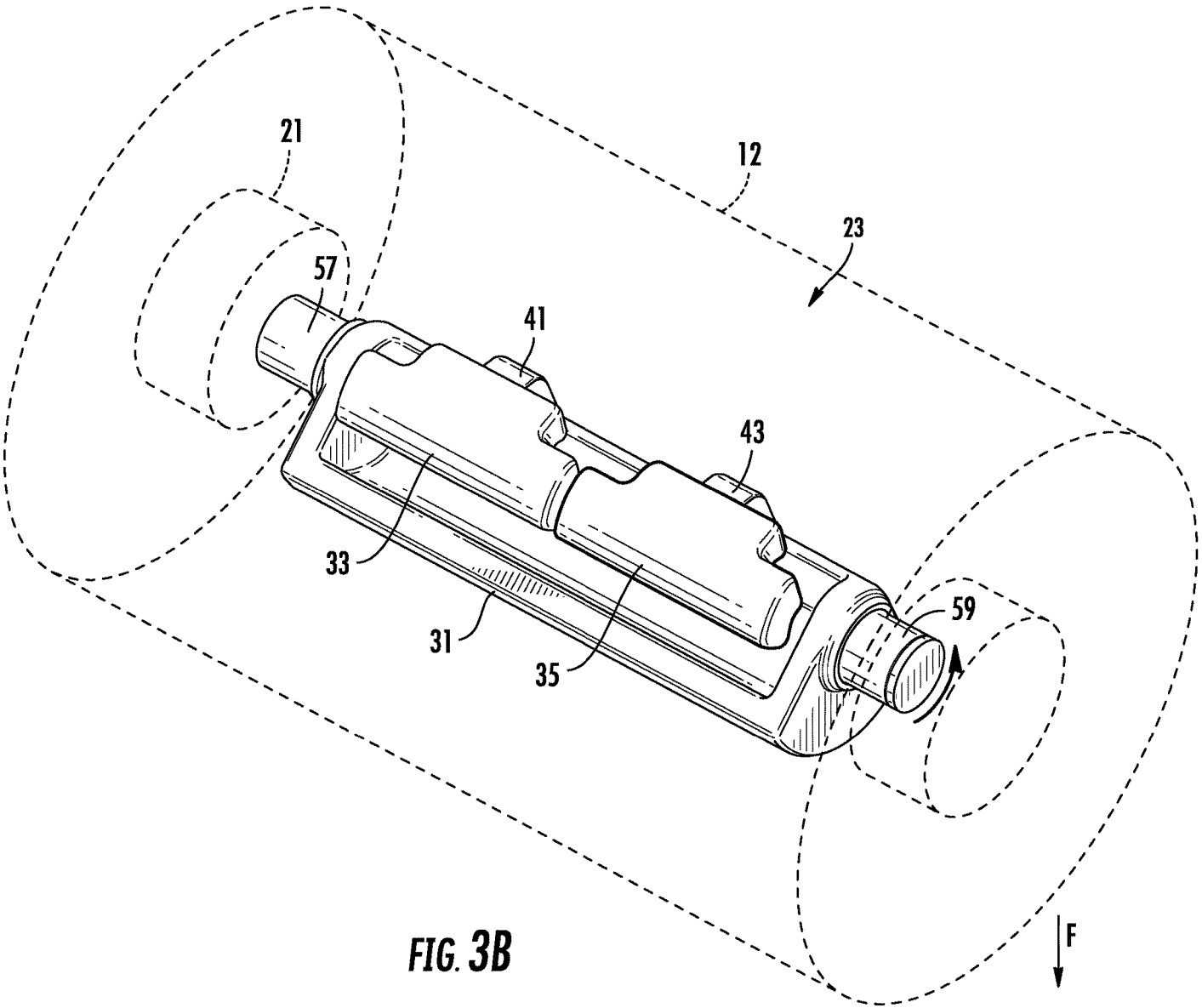

FIGS. 2, 3A, and 3B schematically illustrates a drum 12 including a vibratory eccentric system provided with a vibration motor 21 and an eccentric assembly 23 therein according to some embodiments of inventive concepts. The vibration motor 21 rotates the assembly 23 about an axis of rotation 24 of the eccentric assembly that is parallel with an axis of rotation of the drum.

According to one aspect of the present invention, vibration motor 21 is configured to rotate the eccentric assembly 23 in a first direction to provide high amplitude vibration and in a second direction that is opposite the first direction to provide low amplitude vibration. Vibrations generated by the rotation of the eccentric assembly increase the force F the compacting surface (i.e., drum 12) exerts on the work surface 15 (e.g., soil, asphalt, etc.) and provides improved compaction.

FIGS. 3A and 3B are enlarged perspective views of an eccentric assembly of FIG. 2 in respective high and low amplitude orientations according to some embodiments of inventive concepts. As shown, eccentric assembly 23 includes outer eccentric mass 31 provided with a shape that is elongated relative to lengths of inner eccentric masses 33 and 35 with a length in a direction of an axis of rotation 24 of the outer eccentric mass. First inner eccentric mass 33 is rotatably connected to outer eccentric mass 31 by first joint (including tabs 37*a*, 37*b*, and 37*c*, and pin 37*d*), and second inner eccentric mass 35 is rotatably connected to outer eccentric mass 31 by second joint (including tabs 39*a*, 39*b*, and 39*c*, and pin 39*d*). Moreover, first and second inner eccentric masses 33 and 35 are separate, and the respective first and second joints are separate.

Outer eccentric mass 31 may include an elongate recess therein with the recess being substantially co-directional with the length of the outer eccentric mass. Stops 41 and 43 may extend from outer eccentric mass 31. Accordingly, inner eccentric masses 33 and 35 may be connected to rotate against a wall 34 of the outer eccentric mass 31 in the recess in a high amplitude orientation (as shown in FIG. 3A) or against respective stops 41 and 43 in a low amplitude orientation (as shown in FIG. 3B). For high amplitude vibration, vibration motor 21 is thus configured to rotate outer eccentric mass 31 in a first direction (indicated by the rotational arrow of FIG. 3A) so that the first and second inner eccentric masses move to respective high amplitude (first) positions as shown in FIG. 3A. In the high amplitude positions, each of the inner eccentric masses may thus be seated/stopped against wall 34 of the recess of the outer eccentric mass and spaced apart from the respective low amplitude stops 41 and 43.

For low amplitude vibration, vibration motor 21 is configured to rotate outer eccentric mass 31 in a second direction (indicated by the rotational arrow of FIG. 3B) so that the first and second inner eccentric masses move to respective low amplitude (second) positions against stops 41 and 43 as shown in FIG. 3B. More particularly, stop 41 extends from outer eccentric mass 31 with stop 41 being longitudinally centered with respect to the center tab 37*c* of the first joint and with respect to the center of mass 46 of inner eccentric mass 33 (shown in FIGS. 4 and 5). Similarly, stop 43 extends from outer eccentric mass 31 with stop 43 being longitudinally centered with respect to center tab 39*c* of the second joint and with respect to the center of mass of inner eccentric mass 35, and with stops 41 and 43 being spaced apart. By providing separate stops 41 and 43 that are spaced apart (as opposed to one continuous stop), a mass of material extending beyond the axis of rotation opposite the outer eccentric mass (and thus counteracting high amplitude vibration) may be reduced.

Figure 4:
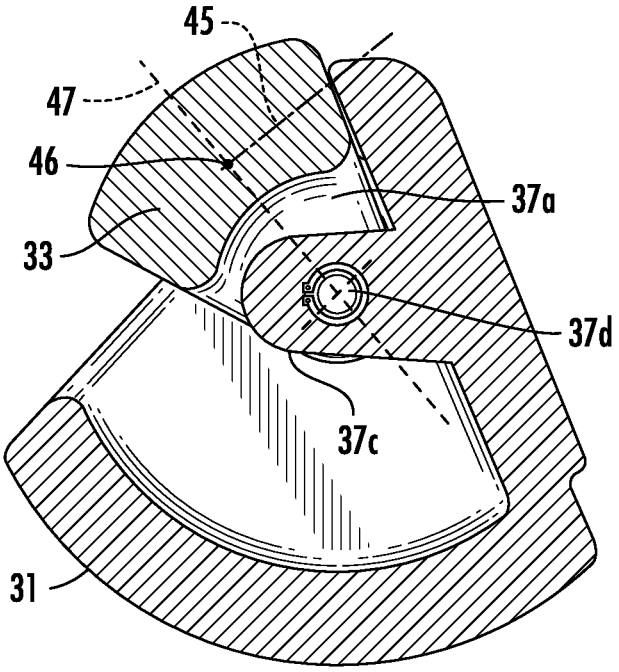
FIG. 4 is a cross sectional view of the eccentric assembly of FIGS. 3A and 3B taken perpendicular to the axis of rotation according to some embodiments of inventive concepts.

With inner eccentric masses 33 and 35 in low amplitude positions against respective stops 41 and 43, a line of action 45 of each stop 41 and 43 extends through the center of mass 46 of the respective inner eccentric mass and orthogonal to the axis of rotation of the respective joint as shown in FIG. 4. Moreover, radial line 47 extends though the center of mass of the inner eccentric mass and the axis of rotation defined by pin 37*d*. Accordingly, a moment arm of a joint pin 37*d*, 39*d* used in a respective joint may be increased giving greater resistance against a load from the respective inner eccentric mass 33 and 35 trying to rotate about a low amplitude stop point, thereby reducing load on the pin when the inner eccentric mass contacts the stop.

Figure 5:
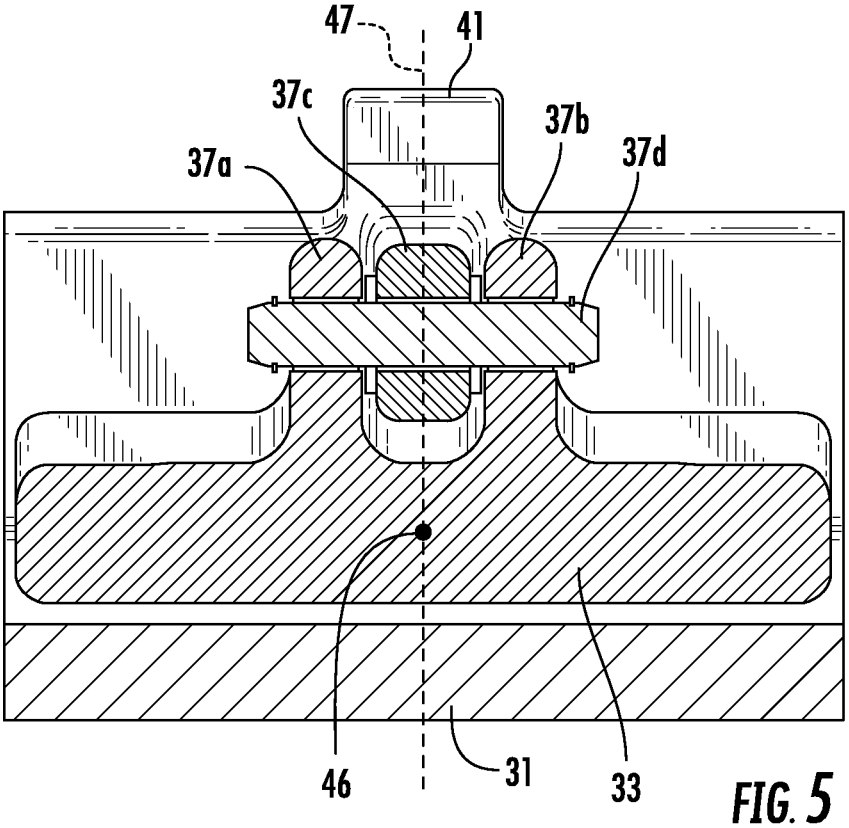
FIG. 5 is a cross sectional view of the eccentric assembly of FIGS. 3A, 3B, and 4 taken parallel to the axis of rotation according to some embodiments of inventive concepts.

As shown in FIG. 3A, the first joint (including tabs 37*a*, 37*b*, and 37*c*, and tab 37*d*) and the second joint (including tabs 39*a*, 39*b*, and 39*c*, and tab 39*d*) are spaced apart in the direction of the axis of rotation of the outer eccentric mass. Moreover, the first joint is aligned with a center of mass of inner eccentric mass 33, and the second joint is aligned with a center of mass of the inner eccentric mass 35. Stated in other words, a center of mass of each inner eccentric mass may be radially aligned with a longitudinal center of the respective joint as discussed in greater detail below with respect to FIGS. 4 and 5. More particularly, the first and second joints may be respective double shear joints (also referred to as pin joints or knuckle joints), with each joint including one tab extending from the outer eccentric mass in a direction orthogonal with respect to the axis of rotation, two tabs extending from the inner eccentric mass, and a pin extending through the three tabs. FIG. 5 is a cross sectional view illustrating elements of the first joint (including tabs 37*a*, 37*b*, and 37*c*, and pin 37*d*) used for eccentric mass 33. As shown, tabs 37*a* and 37*b* extend from inner eccentric mass 33, tab 37*c* extends from outer eccentric mass 31 between tabs 37*a* and 37*b*, and pin 37*d* extends through each of tabs 37*a*, 37*b*, and 37*c*. For each double shear joint, the pin thus defines an axis of rotation of the double shear joint that is parallel with the axis of rotation of outer eccentric mass 31. According to some embodiments, the axis of rotation of outer eccentric mass 31, the axis of rotation of the first joint (defined by pin 37*d*), and the axis of rotation of the second joint (defined by pin 39*d*) may all be coincident. Moreover, each of these axes of rotation may be coincident with the axis of rotation of drum 12.

As shown in FIGS. 4 and 5, center of mass 46 of eccentric mass 33 may thus be radially aligned with a longitudinal center of the first joint indicated by line 47. For example, center of mass 46 of inner eccentric mass 33 may be radially aligned with a center tab (e.g., tab 37*c*) of the respective joint. While center tab 37*c* is shown extending from outer eccentric mass 31, center tab 37*c* could extend from inner eccentric mass 33 with tabs 37*a* and 37*b* extending from outer eccentric mass 31.

The double shear joint design of FIGS. 3A and 5 thus supports the pin in double shear to reduce bending load on the pin that may result from weight of the respective inner eccentric mass and/or centrifugal force of the respective inner eccentric mass. Moreover, by providing two separate inner eccentric masses 33 and 35, the respective double shear joints (also referred to as pin joints or knuckle joints) are isolated from each other, thereby reducing bending load on the pins that could result from bending of a single longer inner eccentric mass and/or bending of the outer eccentric mass. Each pin may thus be substantially subjected to only a shearing load. Moreover, each tab 37*c*, 39*c* extending from the outer eccentric mass 31 may be aligned with a center of mass of the respective inner eccentric mass 33, 35 in a radial direction from the axis of rotation defined by the respective pin 37*d*, 39*d*.

Figure 6:
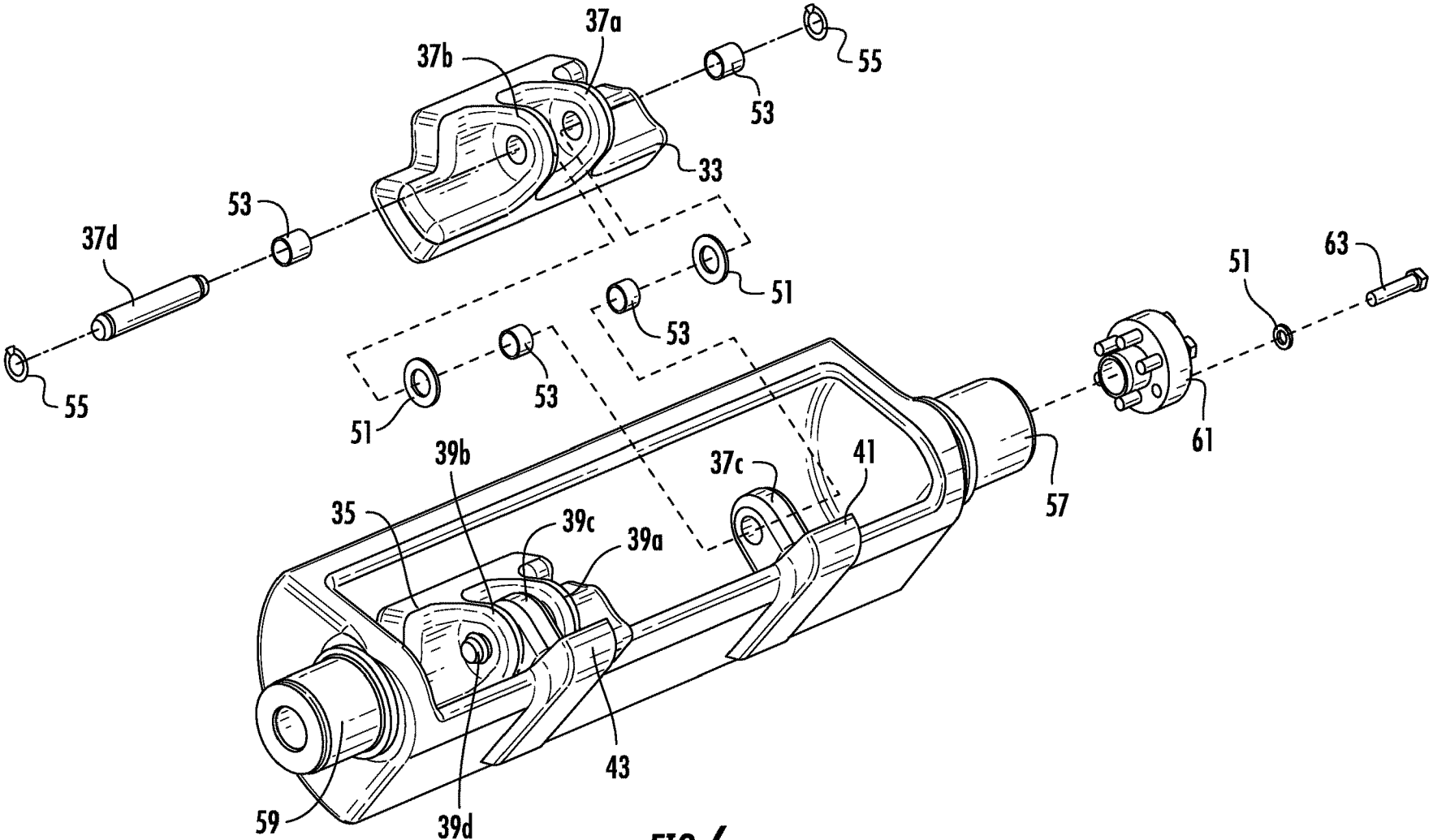
FIG. 6 is an exploded view of the eccentric assembly of FIGS. 3A, 3B, 4, and 5 according to some embodiments of inventive concepts.

FIG. 6 is an exploded view of eccentric assembly 23 of FIG. 2 according to some embodiments of inventive concepts. The first joint thus includes tabs 37*a*, 37*b*, and 37*c* and pin 37*d*, and the second joint includes tabs 39*a*, 39*b*, and 39*c* and pin 39*d*. In addition, each joint may include washers 51, bushings 53, and snap rings 55 (used to hold the pin in place) as shown in the exploded view of the first joint. Outer eccentric mass 31 may also include mounting journals 57 and 59 extending from opposite ends thereof. These mounting journals 57 and 59 may be provided to rotatably mount the eccentric assembly within drum 12 of FIG. 2 on the desired axis of rotation. In addition, coupling 61 may be attached to mounting journal 57 using washers 51 and screws 63 to provide rotational drive input from vibration motor 21 of FIG. 2. Journal 59 may mount to vibration motor 21 and/or drum 12 of FIG. 2.

By providing multiple inner eccentric masses, double shear joints for each inner eccentric mass, and/or raised stops for the low amplitude operation, stress on the joint pins may be reduced thereby reducing pin failure and/or allowing reduced pin size/material (i.e., less expensive pins may be used). Raised stops 41 and 43 for low amplitude operation may reduce impact load on the joint pins when the respective inner eccentric masses contact the respective stops 41 and 43. By supporting joint pins in double shear using tabs as discussed above, bending load on the pins may be reduced. By providing separate inner eccentric masses 33 and 35, the joint pins for the respective inner eccentric masses may be isolated from each other to thereby reduce bending load on the joint pins due to deflection of a longer inner eccentric mass and/or deflection of the outer eccentric mass. Use of a split inner eccentric mass and loose fit joint pins may also increase ease of assembly and/or serviceability.

As shown in FIGS. 3A, 3B, and 6, inner eccentric masses 33 and 35 may have the same mass, size, and shape, for example, to provide symmetry for the eccentric assembly. According to some other embodiments, eccentric masses 33 and 35 may have different masses, sizes, and/or shapes, for example, to compensate for a non-centered placement of the eccentric assembly in a drum (e.g., shifted to one side of the drum or the other).

In addition, efficient use of mass in shaping of the outer eccentric mass 31 and inner eccentric masses 33 and 35 may provide improved efficiency of use with reduced power draw and thus reduced fuel consumption without reducing functional performance. Accordingly, design flexibility for a compaction machine 10 may be increased by allowing use of smaller and/or more efficient components (e.g., for hydraulic and/or powertrain systems).

Moreover, while two inner eccentric masses are discussed by way of example, eccentric assemblies may include any number of inner eccentric masses according to some embodiments of inventive concepts. For example, three inner eccentric masses may be used with one outer eccentric mass, and a separate double shear joint and low amplitude stop may be provided for each of the three inner eccentric masses. According to some other embodiments, a double shear joint and/or stop may be used according to some embodiments in an eccentric assembly with only one inner eccentric mass. In such a system, the double shear joint and/or low amplitude stop could be centered with respect to the center of mass of the single inner eccentric mass.

Figure 7:
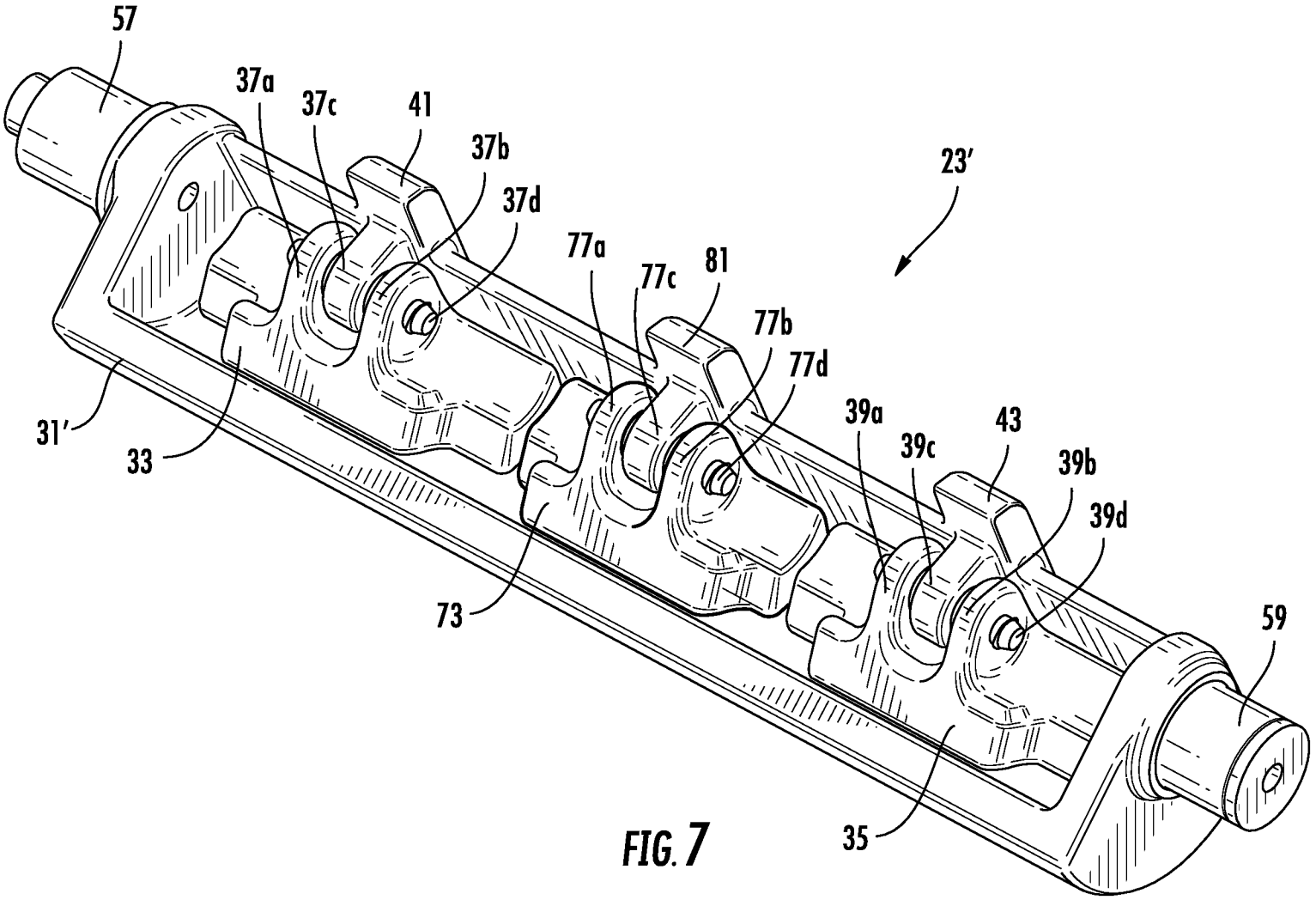
FIG. 7 illustrates an example of an eccentric assembly including an outer eccentric mass and first, second, and third inner eccentric masses according to some embodiments of inventive concepts.

FIG. 7 illustrates an example of an eccentric assembly including an outer eccentric mass and first, second, and third inner eccentric masses according to some embodiments of inventive concepts. In FIG. 7, outer eccentric mass 31' may be similar to outer eccentric mass 31 of FIGS. 3A and 3B except that outer eccentric mass 31' is longer with a longer recess, and with an additional stop 81 and an additional tab 77*c* to accommodate third inner eccentric mass 73. Inner eccentric mass 33 and related elements (including tabs 37*a*, 37*b*, and 37*c*, and stop 41) and inner eccentric mass 35 and related elements (including tabs 39*a*, 39*b*, 39*c*, and stop 43) may be substantially the same as inner eccentric masses 33 and 35 (and related elements) of FIGS. 3A and 3B. In addition, the eccentric assembly of FIG. 7 may include third inner eccentric mass 73 between inner eccentric masses 33 and 35, and tabs 77*a*, 77*b*, and 77*c*, and pin 77*d* may provide a double shear joint for inner eccentric mass 73. Inner eccentric mass 73 may thus rotate between a high amplitude position (spaced apart from stop 81) and a low amplitude position (against stop 81) depending on a direction of rotation of the eccentric assembly 23', as discussed above with respect to inner eccentric masses 33 and 35.

Third inner eccentric mass 73, for example, may be useful for a larger eccentric assembly where use of only two eccentric masses might require lengths that are longer than desired. Moreover, a size/mass of inner eccentric mass 73 (in the middle) may be different than sizes of inner eccentric masses 33 and 35 while still maintaining symmetry of the eccentric assembly. For example, a mass/length of inner eccentric mass 73 may be less than that of inner eccentric masses 33 and 35 as shown in FIG. 7, or a mass/length of inner eccentric mass 73 may be the same as that of inner eccentric masses 33 and 35, depending on a desired size of the assembly.

In the above-description of various embodiments of the present disclosure, it is to be understood that the terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

When an element is referred to as being "connected", "coupled", "responsive", "mounted", or variants thereof to another element, it can be directly connected, coupled, responsive, or mounted to the other element or intervening elements may be present. In contrast, when an element is referred to as being "directly connected", "directly coupled", "directly responsive", "directly mounted" or variants thereof to another element, there are no intervening elements present. Like numbers refer to like elements throughout. As used herein, the singular forms "a", "an" and "the" are intended to include the plural forms as well, unless the context clearly indicates otherwise. Well-known functions or constructions may not be described in detail for brevity and/or clarity. The term "and/or" and its abbreviation "/" include any and all combinations of one or more of the associated listed items.

It will be understood that although the terms first, second, third, etc. may be used herein to describe various elements/operations, these elements/operations should not be limited by these terms. These terms are only used to distinguish one element/operation from another element/operation. Thus a first element/operation in some embodiments could be termed a second element/operation in other embodiments without departing from the teachings of present inventive concepts. The same reference numerals or the same reference designators denote the same or similar elements throughout the specification.

As used herein, the terms "comprise", "comprising", "comprises", "include", "including", "includes", "have", "has", "having", or variants thereof are open-ended, and include one or more stated features, integers, elements, steps, components or functions but do not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Persons skilled in the art will recognize that certain elements of the above-described embodiments may variously be combined or eliminated to create further embodiments, and such further embodiments fall within the scope and teachings of inventive concepts. It will also be apparent to those of ordinary skill in the art that the above-described embodiments may be combined in whole or in part to create additional embodiments within the scope and teachings of inventive concepts. Thus, although specific embodiments of, and examples for, inventive concepts are described herein for illustrative purposes, various equivalent modifications are possible within the scope of inventive concepts, as those skilled in the relevant art will recognize. Accordingly, the scope of inventive concepts is determined from the appended claims and equivalents thereof.

The invention claimed is:

1. An eccentric assembly for a compaction machine, the eccentric assembly comprising:

an outer eccentric mass with a length in a direction of an axis of rotation of the outer eccentric mass;

a first inner eccentric mass rotatably connected to the outer eccentric mass by a first joint; and a second inner eccentric mass rotatably connected to the outer eccentric mass by a second joint, wherein the first and second inner eccentric masses are separate, and wherein the first and second joints are separate.

2. The eccentric assembly of claim 1, wherein the outer eccentric mass is a continuous outer eccentric mass, and wherein each of the first and second inner eccentric masses are rotatably connected to the continuous outer eccentric mass.

3. The eccentric assembly of claim 1, wherein the first and second joints are spaced apart in the direction of the axis of rotation of the outer eccentric mass, wherein the first joint is aligned with a center of mass of the first inner eccentric mass, and wherein the second joint is aligned with a center of mass of the second inner eccentric mass.

4. The eccentric assembly of claim 1, wherein the first joint comprises a first double shear joint, and wherein the second joint comprises a second double shear joint.

5. The eccentric assembly of claim 4, wherein the first double shear joint includes a first tab extending from the outer eccentric mass in a direction orthogonal with respect to the axis of rotation, and wherein the second double shear joint includes a second tab extending from the outer eccentric mass in a direction orthogonal with respect to the axis of rotation.

6. The eccentric assembly of claim 5, wherein the first double shear joint includes third and fourth tabs extending from the first inner eccentric mass to opposite sides of the first tab and a first pin extending through the first, third, and fourth tabs, and wherein the second double shear joint includes fifth and sixth tabs extending from the second inner eccentric mass to opposite sides of the second tab and a second pin extending through the second, fifth, and sixth tabs.

7. The eccentric assembly of claim 6, wherein the first pin defines an axis of rotation of the first double shear joint that is parallel with the axis of rotation of the outer eccentric mass, and wherein the second pin defines an axis of rotation of the second double shear joint that is parallel with the axis of rotation of the outer eccentric mass.

8. The eccentric assembly of claim 1, further comprising:

a first stop extending from the outer eccentric mass wherein the first stop is longitudinally centered with respect to the first joint and with respect to the center of mass of the first inner eccentric mass; and a second stop extending from the outer eccentric mass wherein the second stop is longitudinally centered with respect to the second joint and with respect to the center of mass of the second inner eccentric mass, and wherein the first and second stops are spaced apart.

9. The eccentric assembly of claim 8, wherein a line of action of the first stop extends through the center of mass of the first inner eccentric mass and orthogonal to the axis of rotation of the first joint, and wherein a line of action of the second stop extends through the center of mass of the second inner eccentric mass and orthogonal to the axis of rotation of the second joint.

10. The eccentric assembly of claim 8, wherein the outer eccentric mass is provided with at least one recess, wherein the first and second inner eccentric masses are configured to move to respective first positions seated in the at least one recess of the outer eccentric mass and spaced apart from the respective first and second stops responsive to rotation of the outer eccentric mass in a first direction about the axis of rotation of the outer eccentric mass, and wherein the first and second inner eccentric masses are configured to move to respective second positions against the respective first and second stops responsive to rotation of the outer eccentric mass in a second direction about the axis of rotation of the outer eccentric mass.

11. A compaction machine comprising:

a chassis;

a hollow drum rotatably connected to the chassis to allow rotation of the drum over a work surface;

an eccentric assembly mounted inside the drum, wherein the eccentric assembly includes, an outer eccentric mass with a length in a direction of an axis of rotation of the outer eccentric mass, a first inner eccentric mass rotatably connected to the outer eccentric mass by a first joint, and a second inner eccentric mass rotatably connected to the outer eccentric mass by a second joint, wherein the first and second inner eccentric masses are separate, and wherein the first and second joints are separate; and a vibration motor coupled to the eccentric assembly, wherein the vibration motor is configured to rotate the outer eccentric mass in a first direction about the axis of rotation of the outer eccentric mass so that the first and second inner eccentric masses move to respective first positions relative to the outer eccentric mass to provide high amplitude vibration, and wherein the vibration motor is configured to rotate the outer eccentric mass in a second direction about the axis of rotation of the outer eccentric mass so that the first and second inner eccentric masses move to respective second positions relative to the outer eccentric mass to provide low amplitude vibration.

12. The compaction machine of claim 11, wherein the outer eccentric mass is a continuous outer eccentric mass, and wherein each of the first and second inner eccentric masses are rotatably connected to the continuous outer eccentric mass.

13. The compaction machine of claim 11, wherein the first and second joints are spaced apart in the direction of the axis of rotation of the outer eccentric mass, wherein the first joint is aligned with a center of mass of the first inner eccentric mass, and wherein the second joint is aligned with a center of mass of the second inner eccentric mass.

14. The compaction machine of claim 11, wherein the first joint comprises a first double shear joint, and wherein the second joint comprises a second double shear joint.

15. The compaction machine of claim 14, wherein the first double shear joint includes a first tab extending from the outer eccentric mass in a direction orthogonal with respect to the axis of rotation, and wherein the second double shear joint includes a second tab extending from the outer eccentric mass in a direction orthogonal with respect to the axis of rotation.

16. The compaction machine of claim 15, wherein the first double shear joint includes third and fourth tabs extending from the first inner eccentric mass to opposite sides of the first tab and a first pin extending through the first, third, and fourth tabs, and wherein the second double shear joint includes fifth and sixth tabs extending from the second inner eccentric mass to opposite sides of the second tab and a second pin extending through the second, fifth, and sixth tabs.

17. The compaction machine of claim 16, wherein the first pin defines an axis of rotation of the first double shear joint that is parallel with the axis of rotation of the outer eccentric mass, and wherein the second pin defines an axis of rotation of the second double shear joint that is parallel with the axis of rotation of the outer eccentric mass.

18. The compaction machine of claim 11, wherein the eccentric assembly further includes, a first stop extending from the outer eccentric mass wherein the first stop is longitudinally centered with respect to the first joint and with respect to the center of mass of the first inner eccentric mass, and a second stop extending from the outer eccentric mass wherein the second stop is longitudinally centered with respect to the second joint and with respect to the center of mass of the second inner eccentric mass, and wherein the first and second stops are spaced apart.

19. The compaction machine of claim 18, wherein a line of action of the first stop extends through the center of mass of the first inner eccentric mass and orthogonal to the axis of rotation of the first joint, and wherein a line of action of the second stop extends through the center of mass of the second inner eccentric mass and orthogonal to the axis of rotation of the second joint.

20. The compaction machine of claim 18, wherein the outer eccentric mass is provided with at least one recess, wherein the first and second inner eccentric masses are configured to move to the respective first positions seated in the at least one recess of the outer eccentric mass and spaced apart from the respective first and second stops responsive to rotation of the outer eccentric mass in the first direction to provide the high amplitude vibration, and wherein the first and second inner eccentric masses are configured to move to the respective second positions against the respective first and second stops responsive to rotation of the outer eccentric mass in the second direction to provide the low amplitude vibration.

* * * * *